US005586359A

United States Patent [19]

Iida

[11] Patent Number: 5,586,359

[45] Date of Patent: Dec. 24, 1996

[54] LEAF VACUUM WITH ROTARY CUTTING BLADE

[75] Inventor: Giichi Iida, Tokyo, Japan

[73] Assignee: Kioritz Corporation, Tokyo, Japan

[21] Appl. No.: 496,415

[22] Filed: Jun. 29, 1995

[30] Foreign Application Priority Data

Jul. 4, 1994 [JP] Japan ..... 6-174794

[51] Int. Cl.[6] ..... A47L 7/02

[52] U.S. Cl. ..... 15/339; 15/330; 241/56

[58] Field of Search ..... 15/328, 339, 405; 241/55, 56, 101.78; 415/121.1

[56] References Cited

U.S. PATENT DOCUMENTS 4,325,163 4/1982 Mattson et al. ..... 15/330
4,884,314 12/1989 Miner et al. ..... 15/344
4,913,112 4/1990 Iida ..... 123/198
4,951,882 8/1990 Ober ..... 241/55
5,102,056 4/1992 Ober ..... 241/55
5,245,726 9/1992 Rote et al. ..... 15/339

*Primary Examiner*—David Scherbel
*Assistant Examiner*—Terrence R. Till
*Attorney, Agent, or Firm*—Michael D. Bednarek; Kilpatrick & Cody

[57] ABSTRACT

A vacuum cleaner that includes a stationary blade that acts also as a bearing in a suction pipe connected with a fan in the axial line of rotation shaft of the fan. A transmission shaft supported by the bearing extends from the fan rotation shaft of the fan and through the bearing. A rotary blade is mounted at the end of the transmission shaft that extends through the bearing and cooperates with the stationary blade to chop the sucked material finely.

17 Claims, 4 Drawing Sheets

FIG. 4 PRIOR ART
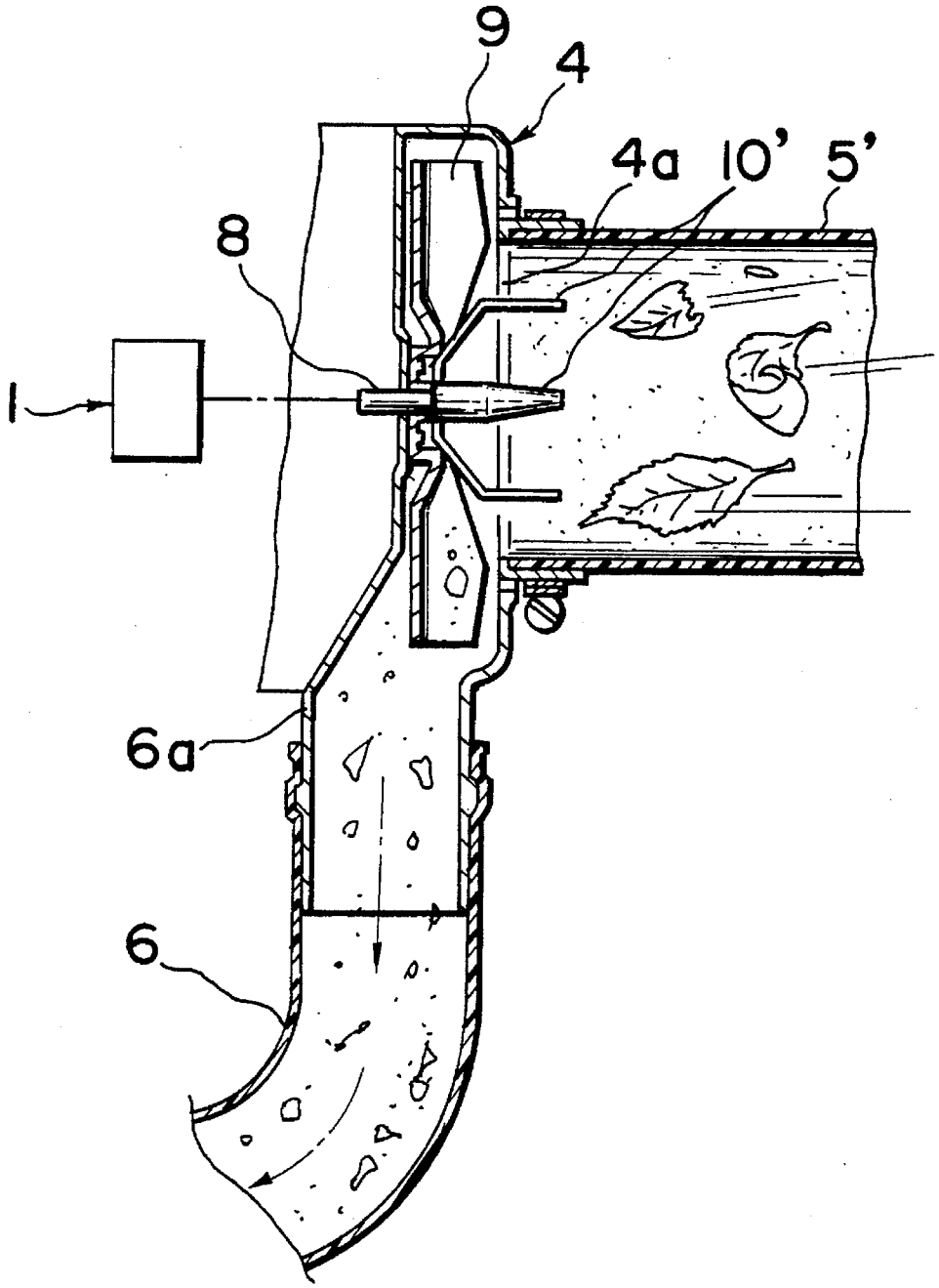

LEAF VACUUM WITH ROTARY CUTTING BLADE

FIELD OF THE INVENTION

The present invention relates to a vacuum cleaner that is useful for collecting fallen leaves, debris and dust.

DESCRIPTION OF PRIOR ART

An example of a prior art vacuum cleaner is shown in FIG. 3 and FIG. 4. As shown therein, the main body of the vacuum cleaner is integrally constructed of an air-cooled two cycle internal combustion engine 1 as a prime mover, a recoil starter 2 for starting the engine 1, a fuel tank 3 and a fan casing 4. A suction pipe 5' is removable connected with a suction nozzle **4*a* of the fan casing 4. An L-shaped outlet pipe 6 is removable connected with an outlet nozzle 6*a* provided on one side of the fan casing 4. A dust bag 7 having proper permeability is attached on a leeward (outlet) end of the outlet pipe 6. The vacuum cleaner also includes handles 11 and 12 as shown in FIG. 3**.

For the vacuum cleaner constructed as described above, a fan 9 (in the form of a rotatable fan blade) is fixed to an output shaft 8 of the engine 1. Immediately before the fan 9, more particularly, on the windward (suction) side of the fan 9, a rotary cutting blade 10' is provided. The rotary blade 10' is axially adjacent to and coaxial with fan 9 and rotates integrally with the fan 9. The rotary blade 10' chops fallen leaves, dirt and dust sucked in the suction pipe 5' (see U.S. Pat. No. 5,245,726).

In case of the vacuum cleaner of prior art, it is difficult to reliably cut and crush sucked fallen leaves, debris and dust into fine particles because of the centrifugal force caused by the fan 9 and because the rotary blade 10' is provided on the windward (suction) side of the fan 9 axially adjacent thereto and rotates integrally with the fan 9. For example, uncut leaves can pass the blade 10 without being cut.

Incomplete cutting, chopping or crushing of the leaves causes several problems. For example, the need to frequently exchange the dust bag 7 or frequently exhaust sucked fallen leaves, debris and dust is inevitable because the dust bag 7 is filled up immediately due to reception of fallen leaves, debris and dust that are insufficiently crushed.

Moreover, fallen leaves and debris that are insufficiently crushed will hang to the rotary blade 10' or the fan 9. The accumulated leaves and debris results in increased suction resistance of the fan 9 and decreased suction efficiency of the fan 9 which leads to decreased scavenging efficiency of the vacuum cleaner.

The prior art construction also presents a safety risk because the rotary blade 10' acting as a shredder is mounted immediately outside of the fan 9. It is possible that workers will be injured when the rotary blade 10' is exposed during maintenance work such as exchanging the suction pipe 5'.

SUMMARY OF THE INVENTION

In view of the foregoing, an object of the invention is to provide a vacuum cleaner having a high dust bag reception efficiency by finely cutting and crushing the sucked fallen leaves, debris and dust, preventing decreases of suction efficiency of the fan that lowers the suction resistance, and having high safety.

To accomplish these objects, a vacuum cleaner according to the present invention comprises a stationary blade that also acts as a bearing in a suction pipe. The stationary blade is coaxial with a fan rotation shaft of the fan. A transmission shaft supported by the bearing extends from the fan rotation shaft secured to the fan through the bearing. A rotary blade is mounted at the end of the transmission shaft that extends through the bearing to chop the sucked material finely cooperating with the stationary blade. The rotary blade is preferably constituted so as to have fan pieces to assist in creating suction.

In operation, the vacuum cleaner of the invention scavenges fallen leaves, debris and dust. More specifically, a fan 9 is rotated by an output shaft 8 of an engine 1 and a fan rotation shaft 15 secured to the fan 9 after start of the engine 1. A rotary blade 10 is rotated by the fan rotation shaft 15 through a transmission shaft 16 extending inside of the suction pipe 5. Further, according to the invention, a stationary blade 14 is provided downwind of the rotary blade 10 in the suction pipe 5.

By virtue of this construction, the fallen leaves, debris and dust sucked in the suction pipe 5 are crushed on contact with the rotary blade 10 provided in the suction pipe 5, and then chopped finely by clipping action of the rotating blade 10 and stationary blade 14 provided immediately downstream (leeward) of the rotary blade 10. The finely crushed fallen leaves and debris is received in a dust bag 7 provided (downstream) leeward of the vacuum's outlet side by the action of the fan 9, resulting in higher reception efficiency of the dust bag 7 than that of prior art.

Further, the suction efficiency of the fan 9 does not decrease during use because suction resistance of the fan 9 does not increase during use since the problem of uncrushed fallen leaves and dust hanging to the fan 9 is obviated. Further, when the rotary blade 10 is made so as to have fan pieces, the suction efficiency of the fan 9 is further improved.

In addition, providing the rotary blade 10 in the suction pipe 5 results in better safety so that when the suction pipe 5 is removed to exchange the suction pipe 5 or perform maintenance work, no injury of workers occurs contacting with the rotary blade 10, since the rotary blade 10 is not exposed outside as in the case of prior art.

BRIEF DESCRIPTION OF DRAWINGS

FIG. 4 is a sectional view of a fan and a rotary blade of the vacuum cleaner according to prior art shown in FIG. 3.

DETAILED DESCRIPTION OF THE INVENTION

Figure 1:
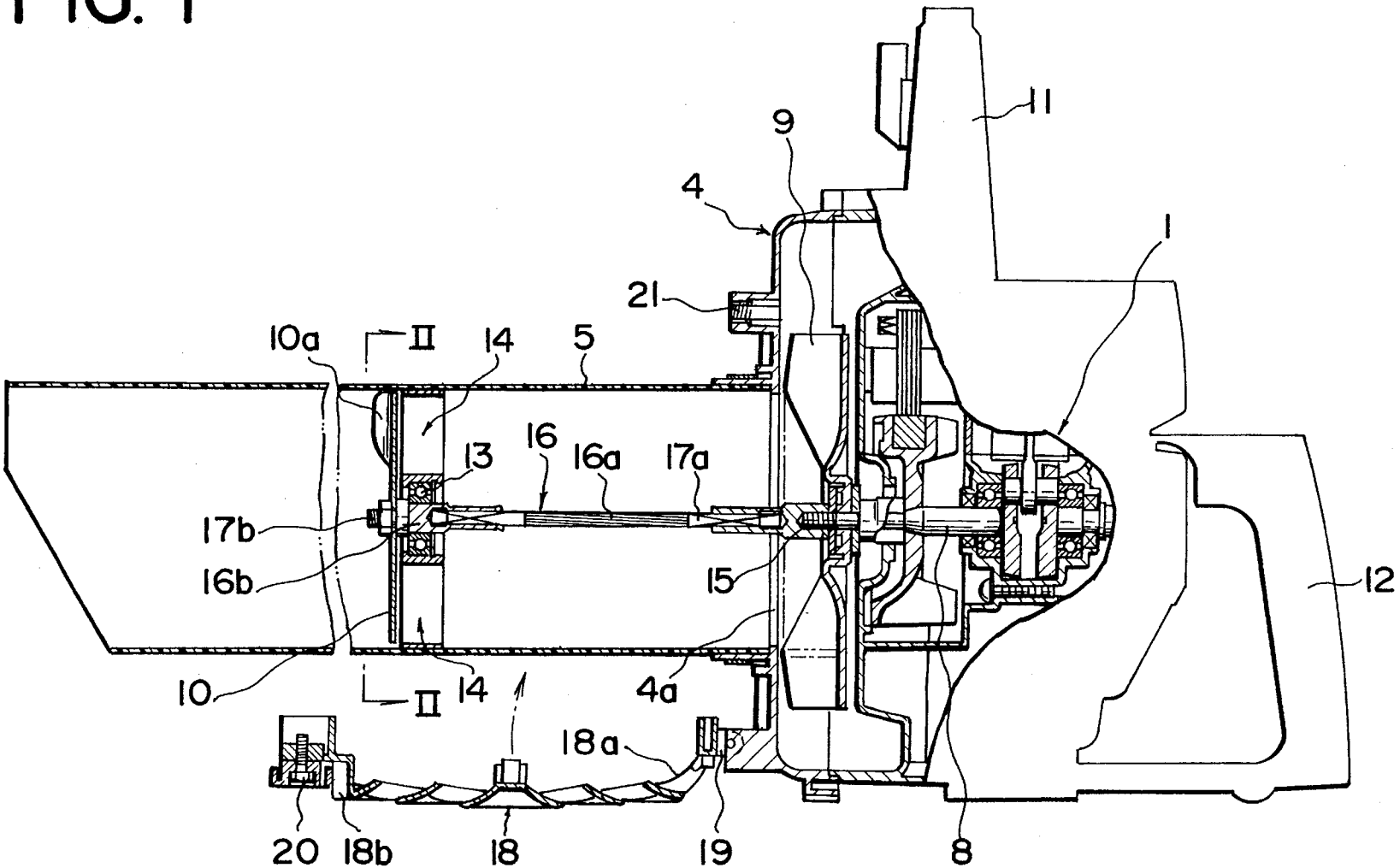
FIG. 1 is a sectional side view of main part of the vacuum cleaner according to an embodiment of the invention.
Figure 2:
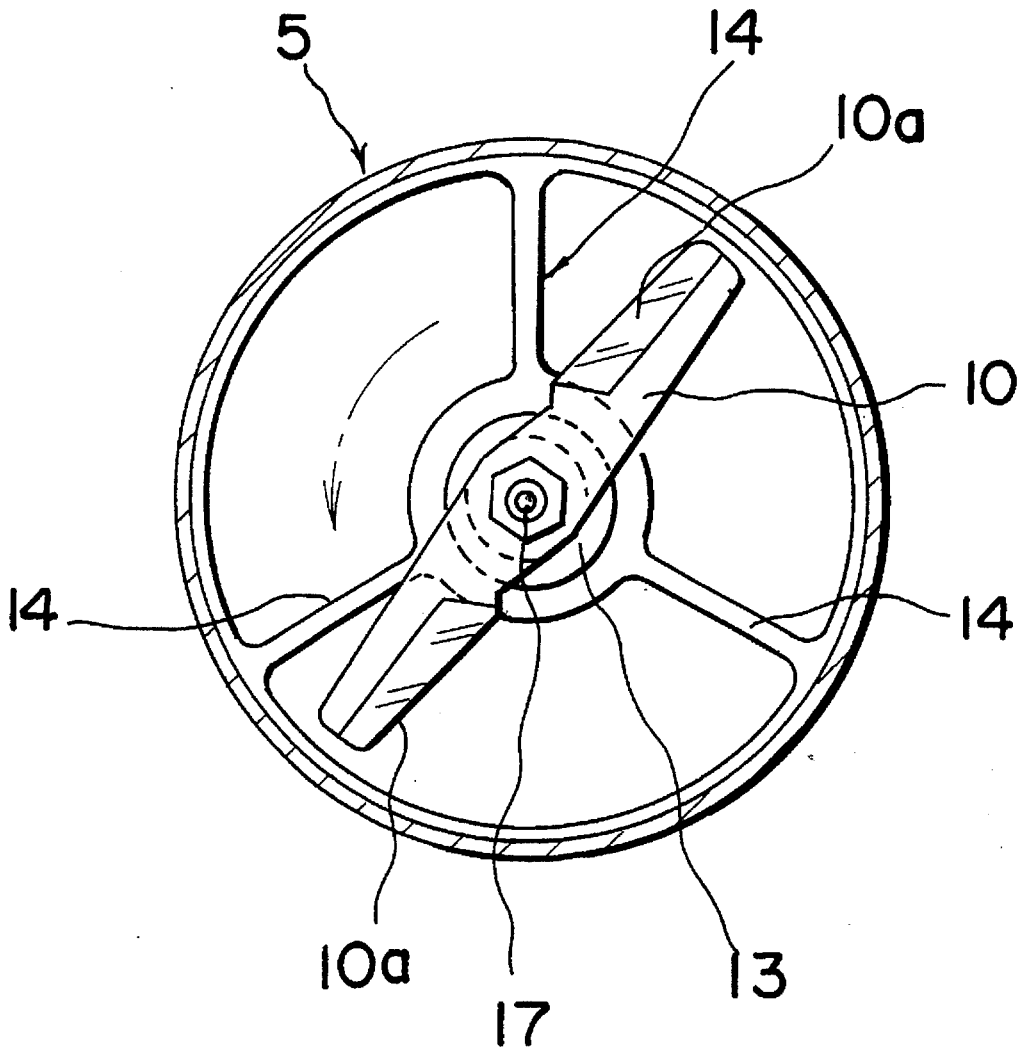
FIG. 2 is a sectional end view taken on line II—II of FIG. 1.
Figure 3:
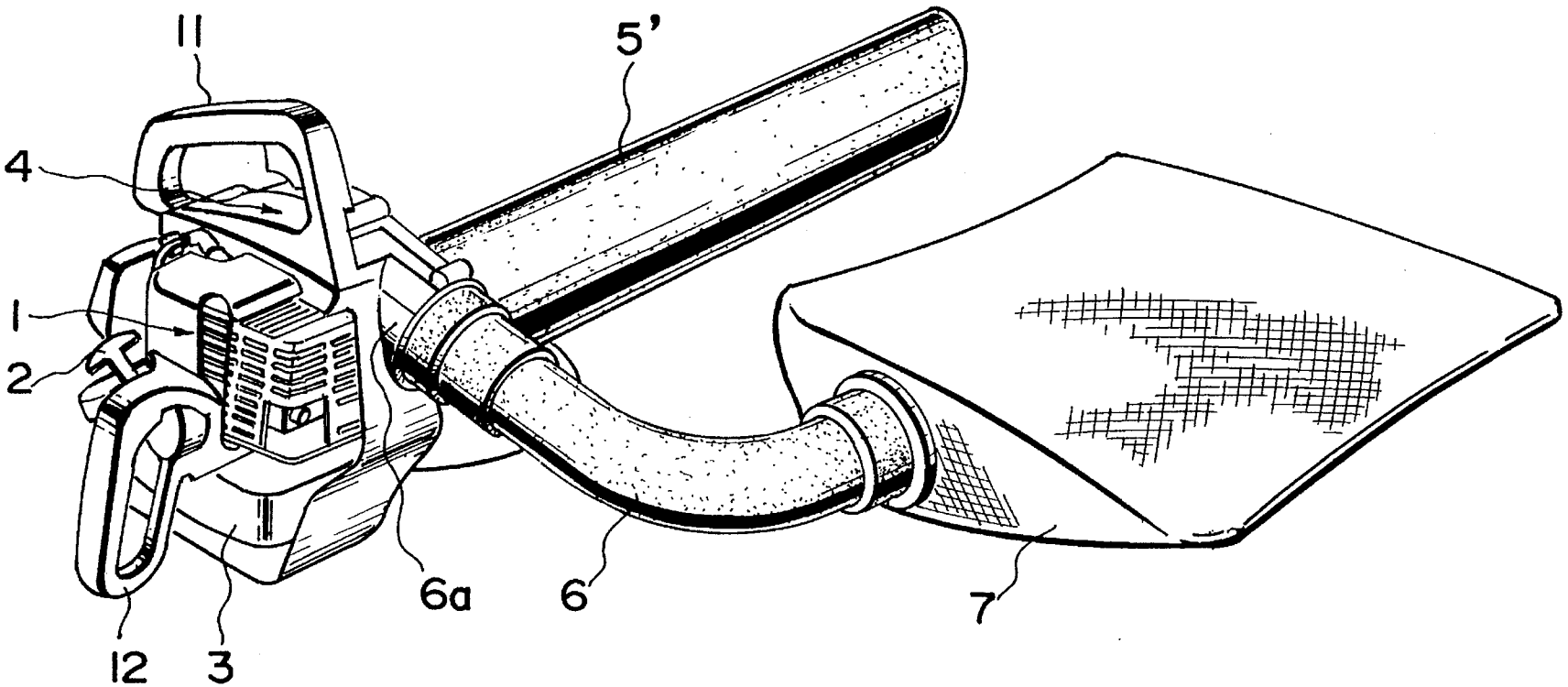
FIG. 3 PRIOR ART
FIG. 3 is a perspective view of a prior art vacuum cleaner.

In the following description, the reference numerals used to label elements in FIGS. 1 and 2 are the same as the reference numerals used in FIGS. 3 and 4 for the same components.

As best shown in FIG. 1, the main body of the vacuum cleaner of the present invention is similar to that of the prior art in that it includes an air-cooled two cycle internal combustion engine 1 as a prime mover, a recoil starter 2 for starting the engine 1, a fuel tank 3 and a fan casing 4. Further, a suction pipe 5 is removable connected with the body at the axial line of a fan rotating shaft 15 that is rotatably secured to the fan 9. The fan rotation shaft 15 is directly connected with the output shaft 8 of the engine 1.

A stationary blade 14 in the shape of a straightening blade that also acts as a support for a rolling element bearing 13 is provided in the suction pipe 5 at a location that is axially spaced at an appropriate distance from the fan 9. In the embodiment shown, the stationary blade 14 is spaced from the fan 9 by a distance greater than the diameter of the suction pipe 5. As best shown in FIG. 2, the stationary blade 14 includes radially extending webs that support a cylindrical bearing support that supports the bearing 13. A transmission shaft 16 extends from the fan rotation shaft 15 and through the center of the stationary blade 14. The transmission shaft 16 is supported by the bearing 13. A rotary blade 10 is mounted at the end **17*b* of the transmission shaft 16 that extends axially beyond the stationary blade 14**.

Preferably, the transmission shaft 16 includes a flexible shaft portion. In the embodiment shown, the transmission shaft 16 consists of a flexible shaft portion 16a on the side of the fan 9 and a non-flexible shaft portion **16*b* on the side of the stationary blade 14. The shaft portions 16*a* and 16*b* are rotatably secured to each other at their opposed inner ends. An outer end 17*a* of the flexible shaft portion 16*a* is fitted rotatably secured to and removable from the fan rotation shaft 15. The non-flexible shaft portion 16*b* is rotatably supported on the bearing 13 and extends through the center of the stationary blade 14. An axially outer end of the non-flexible shaft portion 16*b* projects out from the bearing 13 and the rotary blade 10 is fixed on the end 17*b* of the non-flexible shaft portion 16*b* that extends axially out from the bearing 13**.

The rotary blade 10 is located a minimal distance from the windward (suction) side of the stationary blade 14. By virtue of this construction fallen leaves, debris and dust sucked into the suction pipe 5 are finely crushed by clipping action resulting from cooperation of the rotating rotary blade 10 with the stationary blade 14. More specifically, the fallen leaves, debris and dust sucked into the suction pipe 5 are initially crushed upon contact with the rotary blade 10. Any fallen leaves, debris and dust that hang on the rotary blade 10 without being crushed will rotate with the rotation of the rotary blade 10, into contact with the stationary blade 14 which has edges along the radial webs at positions dividing the inner circle of the suction pipe 5 into three equal parts to ensure that the leaves and dust are crushed.

In addition, because no uncrushed fallen leaves, debris and dust reach and hang onto the fan 9, no decrease of the suction efficiency of the fan 9 is experienced. Further, the reception capacity of the dust bag 7 that collects fallen leaves, debris and dust sucked and crushed is improved because the leaves and dust are crushed more finely and can be packed more densely.

Any thrown cans that are sucked into the suction pipe 5 contact and are rejected by the rotary blade 10 so that damage to the fan 9 or to the dust bag 7 is prevented.

In accordance with another aspect of the present invention and, as shown in FIG. 2, fan pieces **10*a* in the shape of a propeller may be provided on the rotary blade 10 to generate air flow to the fan 9 and assist the suction force of the fan 9 to increase the suction efficiency of the fan 9** further.

Numeral 18 in FIG. 1 refers to a cover for the suction nozzle **4*a* of the fan 9. One end 18*a* of the cover 18 is attached to the main body with a hinge 19. A screw 20 is provided on the other end 18*h* of the cover 18 to engage with an internal thread 21 provided on the main body. When the suction pipe 5 is removed from the fan casing 4 and the main body is to be used as a powered blower, the cover 18 covers the suction nozzle 4*a* of the fan casing 4** to prevent any possible danger.

What is claimed is:

1. A vacuum cleaner comprising:

a housing having an inlet and an outlet;

a suction tube extending from the inlet of the housing;

a fan located within the housing for creating suction in the suction tube;

a motor for driving the fan;

a transmission shaft extending from the fan and rotatably secured to the fan;

a rotary blade secured to the transmission shaft for rotation therewith; and a stationary blade located between the rotary blade and the fan;

wherein fan pieces are provided on the rotary blade such that rotation of the rotary blade creates suction.

2. The vacuum cleaner of claim 1, wherein the suction tube is detachably connected to the housing.

3. The vacuum cleaner of claim 1, wherein the rotary blade is located within the suction tube and axially spaced from the fan.

4. The vacuum cleaner of claim 3, wherein the rotary blade is spaced from the fan by a distance greater than the diameter of the suction tube.

5. The vacuum cleaner of claim 1, further comprising a stationary support for supporting an end of the transmission shaft spaced from the fan.

6. The vacuum cleaner of claim 5, wherein the stationary blade is formed on the stationary support and the stationary support supports the transmission shaft via a rolling element bearing.

7. The vacuum cleaner of claim 1, wherein the transmission shaft includes a flexible shaft portion and a non-flexible shaft portion.

8. The vacuum cleaner of claim 1, wherein the rotary blade and the stationary blade are located adjacent one another in the suction tube.

9. The vacuum cleaner of claim 1, wherein the rotary blade and fan rotate about a common axis.

10. The vacuum cleaner of claim 1, wherein the suction tube is removable from the housing and further comprising a hinged cover adapted to cover the housing inlet when the suction tube is removed.

11. An outdoor vacuum cleaner for picking up and shredding leaves and other debris, the vacuum cleaner comprising:

a housing having an inlet and an outlet;

a suction tube detachably mounted to the housing at the inlet;

a fan located within the housing for creating suction in the suction tube;

a motor for driving the fan;

a rotary blade located in the suction tube;

a stationary blade mounted in the suction tube between the fan and the rotary blade at a location proximate the rotary blade;

a transmission shaft rotatably secured to the fan and extending from the fan past the stationary blade to the rotary blade, whereby the rotary blade is rotatably secured to the transmission shaft and the transmission shaft is supported on the stationary blade;

wherein fan pieces are provided on the rotary blade such that rotation of the rotary blade creates suction.

12. The vacuum cleaner of claim 11, wherein the rotary blade is spaced from the fan by a distance greater than the diameter of the suction tube.

13. The vacuum cleaner of claim 11, wherein the transmission shaft includes a flexible shaft portion and a non-flexible shaft portion.

14. The vacuum cleaner of claim 11, wherein the suction tube is removable from the housing and further comprising a hinged cover adapted to cover the housing inlet when the suction tube is removed.

15. A vacuum cleaner for picking up debris comprising:

a fan body that includes a suction tube having an inlet end and a fan casing;

fan means located with the fan body for creating suction to draw debris into the suction tube;

cutting means comprising rotary blade means and stationary blade means for cutting the debris;

wherein the cutting means is located in the suction tube for cutting debris drawn into the suction tube;

wherein the cutting means comprises a rotary blade and fan pieces are provided on the rotary blade such that rotation of the rotary blade creates suction.

16. The vacuum cleaner of claim 15, wherein the suction tube is detachably connected to the fan casing.

17. The vacuum cleaner of claim 15, further comprising a transmission shaft that includes a flexible shaft portion and a non-flexible shaft portion.

* * * * *